US010035350B2

(12) United States Patent
Gomez et al.

(10) Patent No.: US 10,035,350 B2
(45) Date of Patent: Jul. 31, 2018

(54) WIPE CARTRIDGE CARRIAGE

(71) Applicant: HEWLETT-PACKARD DEVELOPMENT COMPANY, L.P., Houston, TX (US)

(72) Inventors: Francisco Gomez, Barcelona (ES); Rafael Ulacia Portoles, Barcelona (ES); Hector Gomez Minano, Sant Cugat del Valles (ES); Alejandro Mielgo Barba, San Cugat del Valles (ES); Jose Miguel Felguera, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/903,773

(22) Filed: Feb. 23, 2018

(65) Prior Publication Data

US 2018/0178525 A1 Jun. 28, 2018

Related U.S. Application Data

(62) Division of application No. 15/312,323, filed as application No. PCT/EP2014/061260 on May 30, 2014.

(51) Int. Cl.
*B41J 2/165* (2006.01)

(52) U.S. Cl.
CPC ..... *B41J 2/16535* (2013.01); *B41J 2/16517* (2013.01); *B41J 2/16538* (2013.01); *B41J 2/16544* (2013.01); *B41J 2/16547* (2013.01)

(58) Field of Classification Search
CPC ..... B41J 2/16535; B41J 2/16547; B41J 2/16544; B41J 2/16517; B41J 2/16538
See application file for complete search history.

(56) References Cited

U.S. PATENT DOCUMENTS

| | | | | |
|---|---|---|---|---|
| 5,644,346 | A | 7/1997 | Schweibert et al. | |
| 5,806,994 | A | 9/1998 | Coffy et al. | |
| 5,867,185 | A | 2/1999 | Yun | |
| 5,997,126 | A * | 12/1999 | Nguyen | B41J 2/16547 347/22 |
| 6,099,107 | A | 8/2000 | Ford et al. | |
| 6,536,867 | B1 | 3/2003 | James et al. | |
| 6,588,876 | B2 | 7/2003 | Taylor et al. | |
| 7,316,466 | B2 | 1/2008 | Uwagaki et al. | |
| 7,410,097 | B1 | 8/2008 | Mason | |
| 2003/0035019 | A1 | 2/2003 | Dietl et al. | |
| 2007/0046721 | A1 | 3/2007 | Miyazawa | |
| 2007/0222816 | A1 | 9/2007 | Nishi et al. | |
| 2011/0043567 | A1 | 2/2011 | Jung | |
| 2011/0279530 | A1 | 11/2011 | Love | |

* cited by examiner

*Primary Examiner* — Geoffrey Mruk
(74) *Attorney, Agent, or Firm* — Dhand Law PC

(57) ABSTRACT

The present invention is directed at a printhead cleaning assembly, comprising: a frame; a wipe cartridge receptacle mounted on the frame, the receptacle being movable relative to the frame between a first receptacle position and a second receptacle position; a wipe cartridge fixing latch, mounted on the wipe cartridge receptacle, wherein the latch is movable between a closed position and an open position, wherein the latch is coupled to a lock/unlock mechanism that moves the latch between the closed position and the open position in response to a movement of the receptacle between the first receptacle position and the second receptacle position.

13 Claims, 5 Drawing Sheets

WIPE CARTRIDGE CARRIAGE

This patent application is a divisional application of U.S. patent application Ser. No. 15/312,323, filed Nov. 18, 2016, titled "WIPE CARTRIDGE CARRIAGE," which is a National Stage Application of PCT Application Serial No. PCT/EP2014/061260, filed May 30, 2014, titled "WIPE CARTRIDGE CARRIAGE," the relevant contents of each of which herein being incorporated by reference.

BACKGROUND

Printheads eject printing fluid, such as ink, from nozzles. Overtime, some ink residue may accumulate on the nozzle plate. Cleaning of the nozzle plate can be automated by a printhead cleaning assembly.

BRIEF DESCRIPTION OF THE DRAWINGS

Certain examples are described in the following detailed description and in reference to the drawings, in which.

DETAILED DESCRIPTION

In order to allow for long service life and save costs, a cleaning assembly comprises a wipe cartridge which can be replaced when exhausted.

According to one example, there is provided is a wipe cartridge carriage with a wipe cartridge fixing latch, mounted on the wipe cartridge carriage and a procedure for handling the same. The wipe cartridge carriage is mounted on a frame, wherein the carriage is movable relative to the frame at least between a first carriage position and a second carriage position. The latch is movable between a closed position and an open position and coupled to a lock/unlock mechanism that moves the latch between the closed position and the open position in response to a movement of the carriage between the first carriage position and the second carriage position.

Figure 1:
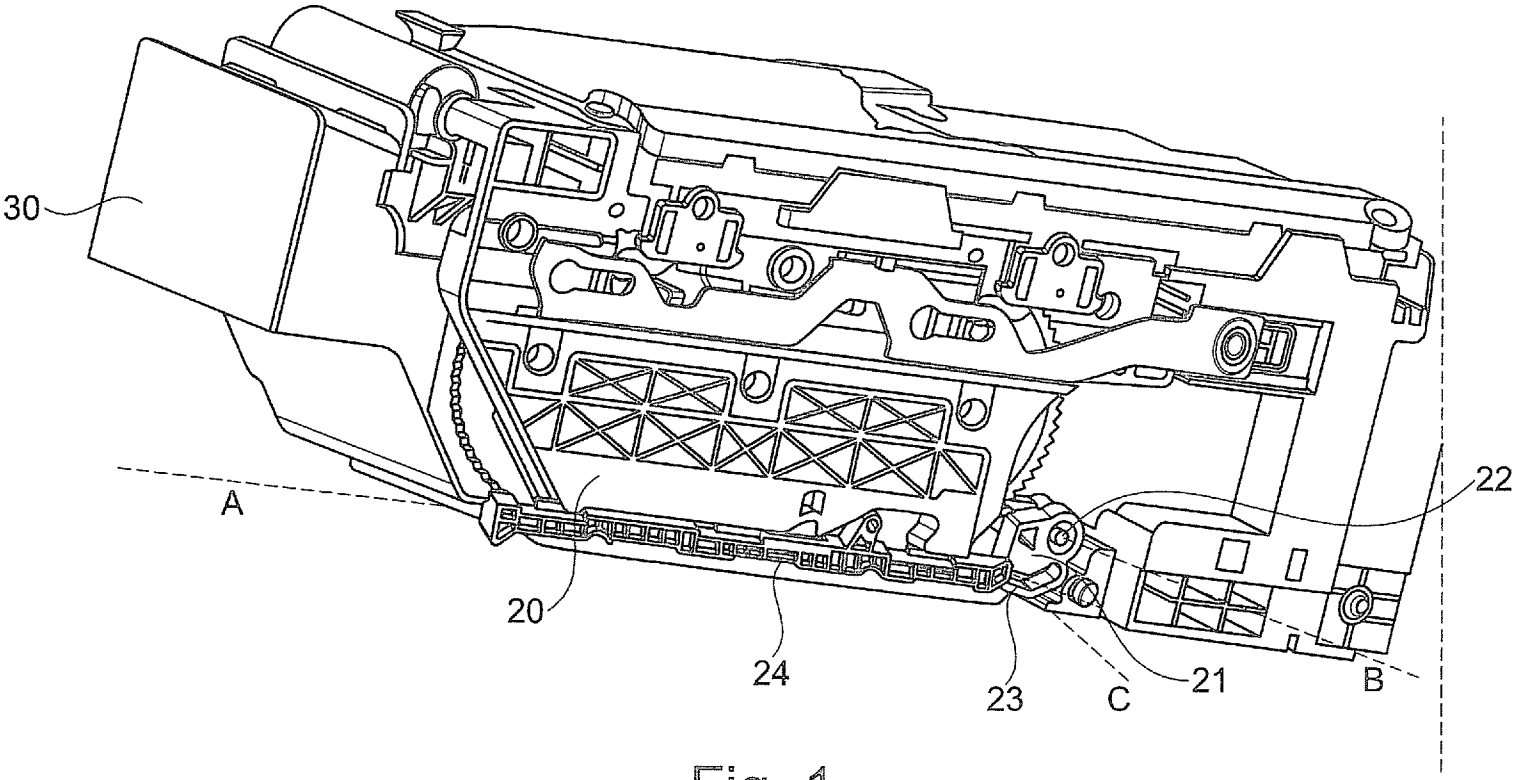
FIG. 1 is a schematic perspective view of a wipe cartridge carriage with the wipe cartridge fixing latch in a closed position, according to one example.

FIG. 1 is a schematic perspective view of a wipe cartridge 30 locked by a wipe cartridge fixing latch 21 to a wipe cartridge carriage 20 according to one example.

As such, the wipe cartridge carriage 20 is a receptacle for receiving the cartridge 30. Hence, the term "wipe cartridge carriage" as used throughout the description should be understood as not being limited to the specific exemplary wipe cartridge carriage 20 shown in FIG. 1. Rather, the term "wipe cartridge carriage" should be understood as encompassing any receptacle that is adapted to receive a wipe cartridge 30 with the wipe cartridge carriage 20 shown in FIG. 1 being only one possible highly-detailed example which is shown for the purpose of illustration only. Equally, the term "wipe cartridge" as used throughout the description and claims should be understood as not being limited to the specific exemplary wipe cartridge 30 shown in FIG. 1, but rather as encompassing any element that is adapted to perform a wiping operation for cleaning a printhead, or other equivalent printing element. The term "wipe cartridge fixing latch" is to be understood as encompassing any element that is adapted to lock a wipe cartridge to the wipe cartridge carriage by moving the latch from an open position, i.e., a position of the latch in which the wipe cartridge is not locked to the wipe cartridge carriage, to a closed position, i.e., a position in which the wipe cartridge is locked to the wipe cartridge carriage.

Furthermore, the terms "wipe cartridge" and "wipe cartridge fixing latch" are replaced in some parts of the description and the claims by the terms "cartridge", and "latch" which should hence be interpreted as referring to the same structural elements. Moreover, the term "wipe cartridge carriage" is replaced in some parts of the description and the claims by the terms "carriage", "wipe cartridge receptacle" or "receptacle" which should hence be interpreted as referring to the same structural element.

As shown in FIG. 1, the wipe cartridge fixing latch 21 is mounted on the wipe cartridge carriage 20. For example, the latch 21 may be mounted on the carriage 20 by a pivot bearing 22. The pivot bearing 22 allows for rotation of the latch 21 around axis B, which runs through the center of the pivot bearing 22.

In FIG. 1, the cartridge fixing latch 21 is in a closed position, wherein the wipe cartridge 30 is locked to the wipe cartridge carriage 20. For moving the latch 21 from the closed position to the open position and reverse, the latch 21 is coupled to a lock/unlock mechanism which, in general terms, may be any arrangement of structural elements that moves the latch 21 between the closed position and the open position.

In the example of FIG. 1, the lock/unlock mechanism is based on a cam mechanism. The cam mechanism comprises a slider 24 which is coupled to the wipe cartridge fixing latch 21. The slider 24 is mounted on the wipe cartridge carriage 20 by a linear bearing. The linear bearing allows moving the slider 24 relative to the carriage 20 along a predetermined axis A. When the slider 24 is moved along axis A to the right, a pin of the slider (not shown) engages with a notch 23 of the latch 21. The notch 23 has a V-shape comprising two parts wherein each part has an elongated shape.

The part with which the pin engages when the latch 21 is in the closed position extends along an axis C that is inclined relative to axis A along which the slider 24 is movable. The diameter of the pin is slightly smaller than the width of the notch 23 which allows the pin to slide along the edges of the notch 23 when the slider 24 is moved. When the slider 24 is moved in the direction of the latch 21 (to the right) along axis A, the pin of the slider applies a force to a contact edge of the notch 23. Since the contact edge of the notch 23 is parallel to axis C which is inclined relative to axis A, the force applied to the contact edge of the notch 23 urges the latch 21 to rotate (clockwise) around axis B which is the axis of the Pivot bearing. When the latch 21 is rotated (clockwise), the inclination angle between axis A and axis C increases.

Moving the slider 24 (to the right) along axis A in the direction of the wipe cartridge fixing latch 21, it forces the latch 21 to rotate (clockwise) around axis B from the closed position to an open position. When the slider 24 is moved back, it forces the latch 21 to rotate (counter-clockwise) around axis B from the open position to the closed position. Thus, generally speaking, moving the slider 24 from a first slider position to a second slider position, moves the latch 21 from the closed position to the open position and vice versa.

Figure 2A:
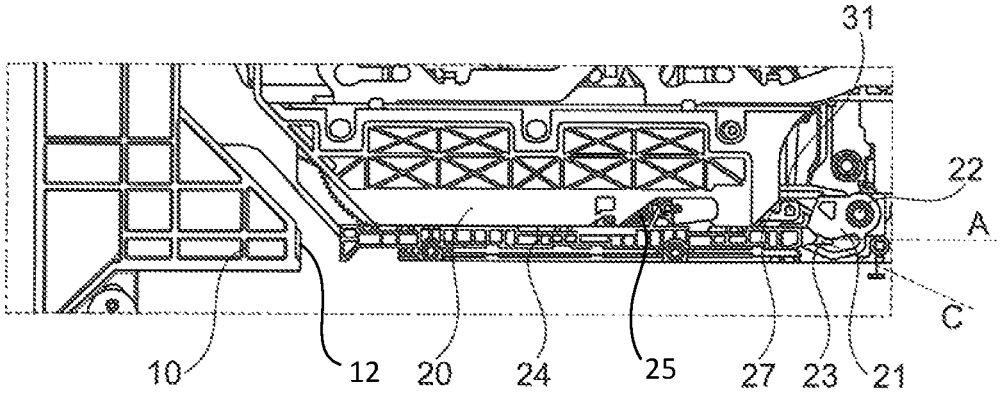
FIG. 2A is a schematic view of the wipe cartridge carriage mounted on a frame with the wipe cartridge fixing latch in the closed position, according to one example.

FIG. 2A shows a schematic view of an example of a printhead cleaning assembly comprising the wipe cartridge carriage 20 and a frame 10 (only partially shown) on which the carriage 20 is mounted. The term "frame" as used throughout the description and the claims should be understood in a broad sense as any structural element or any arrangement of structural elements that is able to support the carriage 20. In particular, frames of different sizes or shapes may be used for supporting the carriage. In the simplest case, the frame is a bar on which the carriage is mounted by a bearing.

As can be seen in FIG. 2A, the latch 21 comprises a hook portion 27. As the latch 21 is in the closed position, the hook portion 27 is engaged with a corresponding recess portion 31 formed in the wipe cartridge 30 (only partially shown). When the hook portion 27 dives into the recess portion 31 of the wipe cartridge 30, the cartridge 30 is locked to the wipe cartridge carriage 20. To secure the lock mechanism, the slider 24 is urged by a flexible urging member 25 attached to the carriage 20 to rest in the first slider position. As shown in FIG. 2, the flexible urging member 25 can be, for example, a spring attached to the slider 24. Thus, when the slider 24 is moved from the first slider position into the direction of the second slider position, a predetermined force of the spring urges the slider 24 to return to the first slider position. Thus, as long as a force applied to the slider 24 urging the slider to move from the first slider position to the second slider position is below the predetermined force of the flexible urging member 25, the cartridge 30 remains locked to the carriage 20.

Figure 2B:
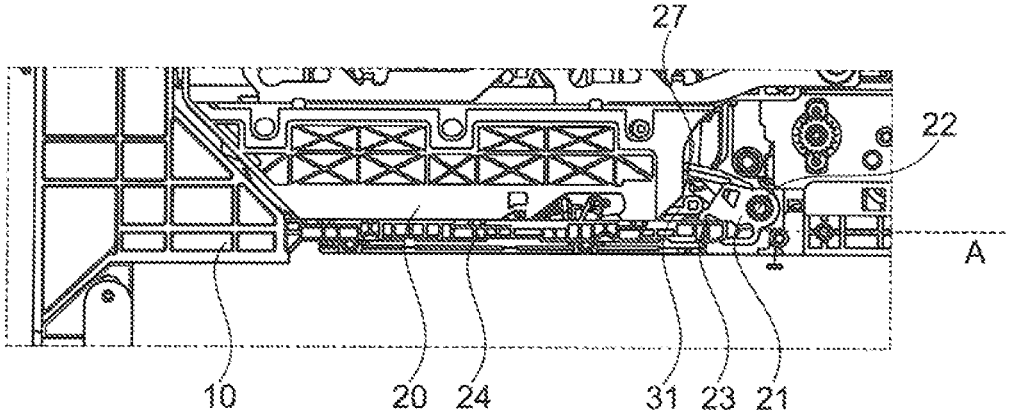
FIG. 2B is a schematic view of the wipe cartridge carriage mounted on a frame with the wipe cartridge fixing latch in an open position, according to one example.

As shown in FIGS. 2A and 2B, the wipe cartridge carriage 20 is movable relative to the frame 10 between a first carriage position (FIG. 2A) and a second carriage position (FIG. 2B). In particular, the carriage 20 is mounted on the frame by a linear bearing which allows for a relative displacement of the carriage 20 parallel to axis A.

When the wipe cartridge carriage 20 is moved parallel to axis A to the left, the slider 25 comes into contact with a stopper 12 positioned on the frame 10. When the slider 25 comes into contact with the stopper 12, the movement of the slider 24 relative to the frame 10 is blocked by the stopper 12. When the carriage 20 is further moved to the left, the slider 24 is moved relative to the carriage 20 (on which it is mounted) from the first slider position to the second slider position. Selecting the stopper 12 as a fixed reference in relation to which the movement of the carriage 20 and the slider 24 are described, it can be said that as long as the slider 24 is in contact with the stopper 12, only the carriage 20 is moved relative to the fixed reference point while the slider 24 remains static.

However, when the carriage 20 is moved from the first carriage position (FIG. 2A) to the second carriage position (FIG. 2B), the slider 24 is moved relative to the carriage 20 from the first slider position to the second slider position. Hence, moving the carriage 20 from the first carriage position to the second carriage position moves the latch 21 from the closed position (FIG. 2A) to the open position (FIG. 2B) and vice versa.

Given the aforesaid, removing of a wipe cartridge 30 from the wipe cartridge carriage 20 of a printer can be conveniently achieved by pulling the carriage 20 with one hand from the first carriage position to the second carriage position (to the left) until the latch 21 is in the open position and pulling the cartridge 30 out of the carriage 20 with the other hand. Analogously, inserting can be achieved by pulling the carriage 20 with one hand from the first carriage position to the second carriage position (to the left) until the latch 21 is in the open position (in case that the latch is not currently open), pushing the cartridge 30 into the carriage 20 with the other hand and pushing the carriage 20 from the second carriage position to the first carriage position (to the right) until the latch 21 is in the closed position.

Figure 2C:
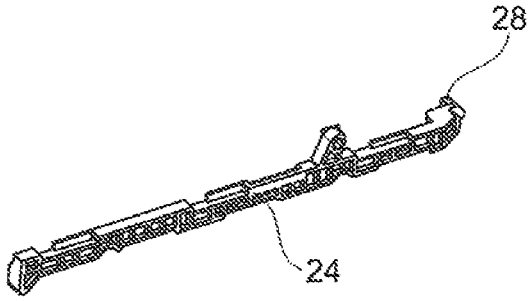
FIG. 2C is a schematic perspective view of a slider of the wipe cartridge carriage, according to one example.
Figure 2D:
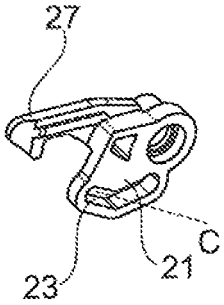
FIG. 2D is a schematic perspective view of the wipe cartridge fixing latch, according to one example.

Perspective views of the slider 24 and the latch 21 are provided in FIGS. 2C and 2D. As can be seen in FIG. 2D, the slider 24 is an element with an elongated shape. When mounted on the wipe cartridge carriage 20, the longitudinal axis of the slider 21 is parallel to axis A as shown in FIGS. 2A and 2B. An end portion of the slider 24, that is to be coupled with the wipe cartridge fixing latch 21, has a protruding portion 28 which forms the above-mentioned pin. The protruding portion 28 extends in orthogonal direction to the longitudinal axis of the slider 24 and has a circular shape whose diameter is smaller than the notch 23 of the latch 21. The notch 23 of the latch 21 comprises the first part where the elongated shape of the notch 23 extends parallel to axis C. During operation, the pin of the slider 24 extends into the notch 23 and forces the latch 21 to rotate clockwise as it is urged against an edge of the notch 23 running parallel to axis C which is inclined relative to axis A along which the slider moves. When the latch 21 is in its open position, the remaining part of the notch 23, i.e., the part that is not parallel to axis C, is parallel to axis A as shown in FIG. 2B, so that any further movement of the slider 24 in the direction of the latch 21 (to the right) does not lead to a rotation of the latch 21. In the open position, the distance between the hook portion 27 and the slider 24 is bigger than when the latch 21 is in the closed position. In other words, when the slider 24 is moved in the direction of the latch 21 along axis A (to the right), the hook portion 27 is rotated away from the slider 21.

Figure 3:
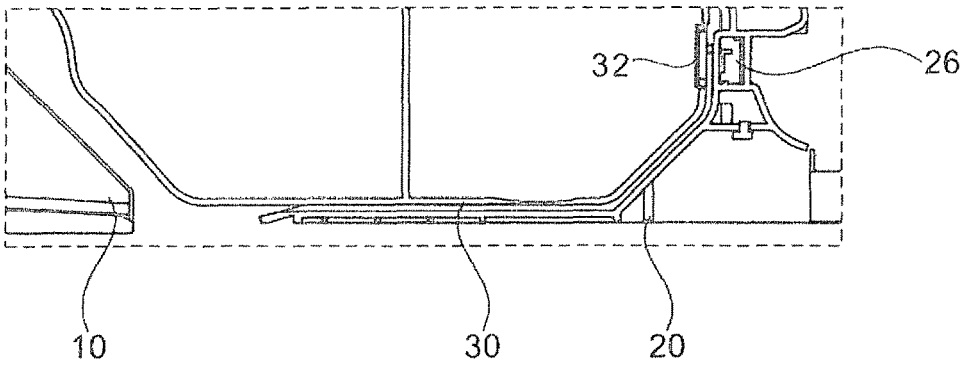
FIG. 3 is a schematic cross-sectional view of the wipe cartridge and the wipe cartridge carriage, according to one example.

As shown in FIG. 3, a magnet 26 may be attached to the wipe cartridge carriage 20 at a predetermined position. Thus, when a sheet metal 32 is attached to the wipe cartridge 30 at a corresponding predetermined position, the magnet 26 applies a magnetic holding force upon the cartridge 30 for securing the cartridge 30 in the carriage 20 during engagement of the above described lock mechanism. The magnet 26 will be sufficiently strong to provide for haptic feedback when the cartridge 30 is inserted into the carriage 20. Further, it may close the gap between the cartridge 30 and the adjacent wall of the carriage 20 to ensure that the cartridge 30 is held and eventually locked in a defined position. The magnet 26 will not be so strong to prevent removing the cartridge 30 from the carriage 20. Alternatively, the magnet may be attached to wipe cartridge 30 at the position of the sheet metal 32 and the sheet metal may be attached to the wipe cartridge carriage at the position of the magnet 26. That is, the position of the magnet 26 and the sheet metal may be switched.

Figure 4:
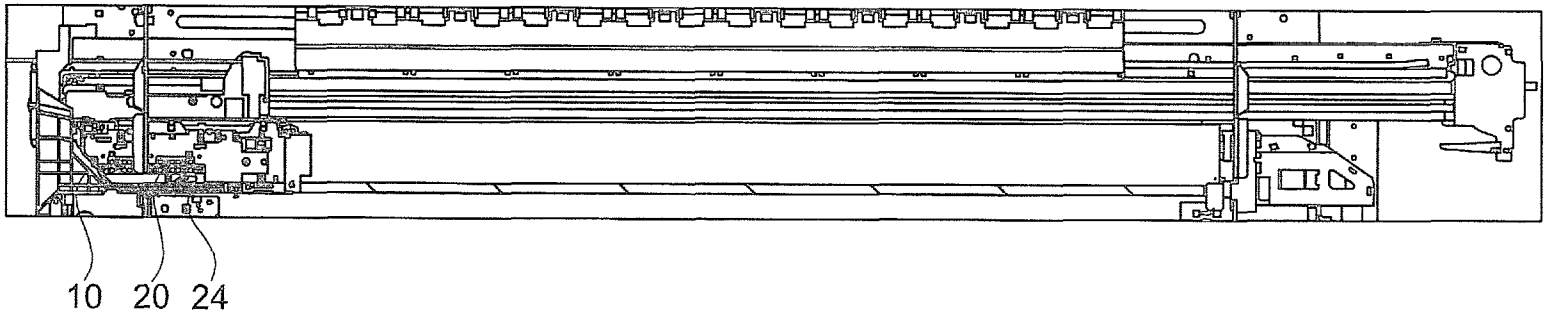
FIG. 4 is a schematic view of a printer comprising the wipe cartridge carriage, according to one example.

FIG. 4 is a schematic view of a page-wide array inkjet printer 1 comprising substantially stationary ink-jet heads for ejecting printing fluid on a substrate. The term "page-wide array printer" as used throughout the description and claims should be understood as not being limited to the specific exemplary page-wide array inkjet printer 1 shown in FIG. 4. Rather, the term "page-wide array inkjet printer"

should be understood as encompassing any printer that uses one or more substantially stationary inkjet heads for ejecting printing fluid on a substrate. Thus, it should be understood that the page-wide array inkjet printer shown in FIG. 1 is only one of many possible examples which is shown for the purpose of illustration only.

The page-wide array inkjet printer 1 further comprises the above-described frame 10 and wipe cartridge carriage 20 mounted on the frame 10. As described with reference to FIGS. 1 to 2B, the carriage 20 is movable relative to the frame 10 between a first carriage position and a second carriage position. Moreover, the page-wide array inkjet printer 1 comprises the wipe cartridge fixing latch 21, mounted on the carriage 20. As described above, the latch 21 is movable between a closed position and an open position. Furthermore, the latch 21 is coupled to the lock/unlock mechanism that moves the latch 21 between the closed position and the open position in response to a movement of the carriage 20 between the first carriage position and the second carriage position.

In the specific example of FIG. 4, the frame 10 comprises a bar traversing the whole printer width. The carriage 20 is mounted on the bar by the linear bearing. The bar extends perpendicular to the substrate path, i.e., the path that a substrate that is to be printed on is guided under the printheads. During cleaning, the wipe cartridge 30 in the carriage 20 is automatically moved parallel to the bar to different cleaning positions which may be distributed over the whole print width. When the cartridge 30 is exhausted and needs replacement, the carriage 20 can be automatically moved to the first carriage position. Service personnel can then pull the carriage 20 in the second carriage position which allows removing the exhausted cartridge 30 as described above. Once the exhausted cartridge 30 is removed, a new wipe cartridge may be inserted and the carriage 20 may be pushed into the first carriage position to lock the new cartridge. The cleaning operation may then be continued by automatically moving the carriage 20 to a cleaning position.

Figure 5:
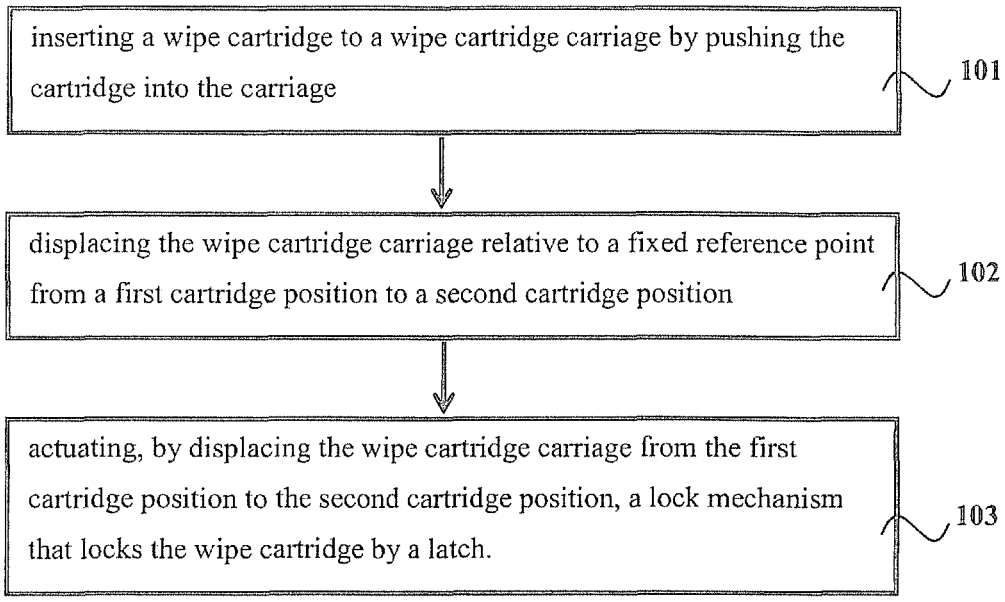
FIGS. 5 and 6 are flow charts of a procedure for handling the wipe cartridge carriage, according to one example.

FIG. 5 is a flow chart of a procedure for handling the wipe cartridge carriage. In particular, the procedure is directed at inserting and locking the wipe cartridge to the wipe cartridge carriage. The procedure starts with step 101 of inserting the cartridge to the carriage by pushing the cartridge into the carriage. In order to lock the cartridge after the cartridge has been inserted into the carriage, the procedure continues at step 102 with displacing the carriage relative to a fixed reference from the first cartridge position to the second cartridge position. As stated above, a fixed reference may be a point on the frame on which the wipe cartridge is mounted. By displacing the carriage relative to the fixed reference from the first cartridge position to the second cartridge position, the slider is moved from the second slider position to the first slider position. When the slider is moved from the second slider position to the first slider position, the wipe cartridge fixing latch locks the wipe cartridge. Hence, the lock mechanism is actuated by displacing the carriage from the first carriage position to the second carriage position as recited in step 103 of the procedure.

If the wipe cartridge carriage comprises a magnet as described with reference to FIG. 3, step 101 of inserting the cartridge to the carriage may comprise pushing the wipe cartridge into the direction of the magnet attached to the carriage. When the sheet metal in the wipe cartridge comes into close vicinity of the magnet, the magnet attracts the sheet metal so that the cartridge is secured in the carriage even before the wipe cartridge fixing latch is in the closed position.

Furthermore, a user gets a haptic feedback so that the wipe cartridge is pushed into the direction of the magnet attached to the carriage until a haptic feedback provided by the magnet attracting and securing the cartridge is sensed by the user.

Step 103 of actuating the lock mechanism releases the slider, which is movably mounted on the carriage, from the stopper, so that the slider moves in relation to the carriage from the second slider position to the first slider position due to the force applied from the flexible urging member. As described above, the flexible urging member moves the slider from the second slider position to the first slider position thereby moving the latch, which is coupled to the slider, from the open position to the closed position. Hence, at step 103, the cartridge is locked to the carriage.

Figure 6:
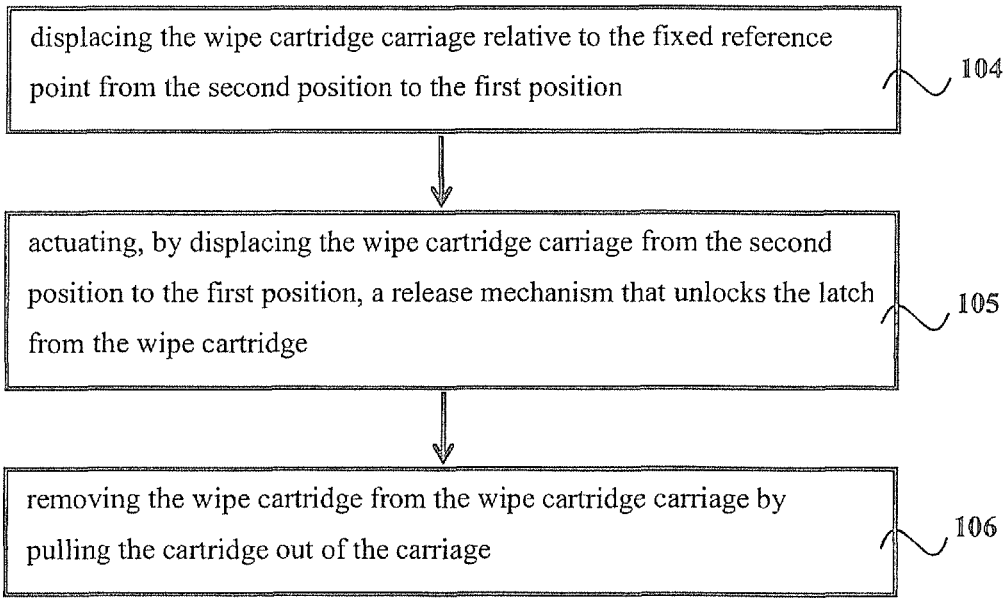

The procedure may be continued as shown in FIG. 6 when it is required to remove the wipe cartridge from the wipe cartridge carriage. In step 104, the wipe cartridge carriage is displaced relative to the fixed reference point from the second carriage position to the first carriage position. Displacing the wipe cartridge carriage from the second carriage position to the first carriage position actuates the release mechanism that unlocks the wipe cartridge fixing latch from the wipe cartridge (step 105). Once the wipe cartridge latch is unlocked from the cartridge, the wipe cartridge can be removed from the wipe cartridge carriage by pulling the cartridge out of the carriage (step 106).

When displacing the wipe cartridge carriage from the second carriage position to the first carriage position, the slider is urged by the stopper from the first slider position to the second slider position, thereby moving the wipe cartridge fixing latch from the closed position to the open position.

After the wipe cartridge has been locked to the carriage as recited in step 103 of the procedure, the carriage may be automatically moved to a cleaning position. Having arrived at the cleaning position, the procedure may continue by the step of cleaning a printhead of a page-wide array inkjet printer. When sensing that the cartridge is exhausted and requires replacement, the carriage may be automatically moved to the first cartridge position where the procedure continues with step 104.

The invention claimed is:

1. A method, comprising:

inserting a wipe cartridge to a wipe cartridge receptacle by pushing the cartridge into the receptacle;

displacing the wipe cartridge receptacle relative to a fixed reference point from a first receptacle position to a second receptacle position; and actuating, by displacing the wipe cartridge receptacle from the first receptacle position to the second receptacle position, a lock mechanism that locks the wipe cartridge by a wipe cartridge fixing latch, wherein the displacing of the wipe cartridge receptacle relative to the fixed reference point provides a force to move the wipe cartridge fixing latch.

2. The method according to claim 1, wherein the inserting the cartridge to the receptacle comprises:

pushing the wipe cartridge into a direction of a magnet attached to the wipe cartridge receptacle.

3. The method according to claim 1, wherein the actuating the lock mechanism comprises:

releasing, by displacing the wipe cartridge receptacle from the first receptacle position to the second receptacle position, a slider, movably mounted on the receptacle, from a stopper, so that the slider moves in relation to the receptacle from a second slider position to a first slider position, thereby moving the wipe cartridge fixing latch, which is coupled to the slider, from an open position to a closed position.

4. The method according to claim 3 further comprising:

displacing the wipe cartridge receptacle relative to the fixed reference point from the second receptacle position to the first receptacle position;

actuating, by displacing the wipe cartridge receptacle from the second receptacle position to the first receptacle position, a release mechanism that unlocks the wipe cartridge fixing latch from the wipe cartridge; and removing the wipe cartridge from the wipe cartridge receptacle by pulling the cartridge out of the receptacle.

5. The method according to claim 4, wherein actuating the release mechanism comprises:

urging, by displacing the wipe cartridge receptacle from the second receptacle position to the first receptacle position, the slider from the first slider position to the second slider position, thereby moving the wipe cartridge fixing latch from a closed position to an open position.

6. The method according to claim 5, wherein the slider is urged from the first slider position to the second slider position by the stopper, in relation to which the receptacle is displaced.

7. The method according to claim 1, wherein the fixed reference point is a frame, the wipe cartridge receptacle being movably mounted on the frame.

8. A method, comprising:

inserting a wipe cartridge to a wipe cartridge receptacle by pushing the cartridge into the receptacle, the wipe cartridge receptacle being mounted on a frame, the wipe cartridge receptacle being movable relative to the frame between a first receptacle position and a second receptacle position;

displacing the wipe cartridge receptacle relative to the frame from the first receptacle position to the second receptacle position; and actuating a lock mechanism by displacing the wipe cartridge receptacle from the first receptacle position to the second receptacle position, the lock mechanism selectively locking or unlocking the wipe cartridge by a wipe cartridge fixing latch, the wipe cartridge fixing latch being movable between a closed position and an open position, wherein the displacing of the wipe cartridge receptacle relative to the frame provides a force to move the wipe cartridge fixing latch between the closed position and the open position.

9. The method according to claim 8, wherein the inserting the cartridge to the receptacle comprises:

pushing the wipe cartridge into a direction of a magnet attached to the wipe cartridge receptacle.

10. The method according to claim 8, wherein the actuating the lock mechanism comprises:

releasing, by displacing the wipe cartridge receptacle from the first receptacle position to the second receptacle position, a slider, movably mounted on the receptacle, from a stopper, so that the slider moves in relation to the receptacle from a second slider position to a first slider position, thereby moving the wipe cartridge fixing latch, which is coupled to the slider, from the open position to the closed position.

11. The method according to claim 8, further comprising:

displacing the wipe cartridge receptacle relative to the frame from the second receptacle position to the first receptacle position;

actuating, by displacing the wipe cartridge receptacle from the second receptacle position to the first receptacle position, a release mechanism that unlocks the wipe cartridge fixing latch from the wipe cartridge; and removing the wipe cartridge from the wipe cartridge receptacle by pulling the cartridge out of the receptacle.

12. The method according to claim 11, wherein actuating the release mechanism comprises:

urging, by displacing the wipe cartridge receptacle from the second receptacle position to the first receptacle position, the slider from the first slider position to the second slider position, thereby moving the wipe cartridge fixing latch from the closed position to the open position.

13. The method according to claim 12, wherein the slider is urged from the first slider position to the second slider position by the stopper, in relation to which the receptacle is displaced.

* * * * *